United States Patent [19]

Lux

[11] 4,443,102

[45] Apr. 17, 1984

[54] COMPACT DEVELOPMENT SYSTEM

[75] Inventor: Richard A. Lux, Webster, N.Y.

[73] Assignee: Xerox Corporation, Stamford, Conn.

[21] Appl. No.: 372,503

[22] Filed: Apr. 28, 1982

[51] Int. Cl.[3] ..... G03G 15/08

[52] U.S. Cl. ..... 355/3 DD; 355/14 D; 118/657

[58] Field of Search ..... 355/3 DD, 14 D; 118/657, 659, 653; 222/DIG. 1

[56] References Cited

U.S. PATENT DOCUMENTS

| | | | |
|---|---|---|---|
| 2,786,439 | 3/1957 | Young | 113/51 |
| 2,846,333 | 8/1958 | Wilson | 117/17.5 |
| 3,015,305 | 1/1962 | Hall et al. | 117/17.5 |
| 3,631,838 | 1/1972 | Kushima et al. | 118/637 |
| 3,951,542 | 4/1976 | Ito et al. | 355/3 DD X |
| 4,067,295 | 1/1978 | Parker et al. | 355/3 DD X |
| 4,067,296 | 1/1978 | Sessink | 118/638 |
| 4,101,211 | 7/1978 | Kayson | 355/3 DD |
| 4,163,614 | 8/1979 | Vock | 355/3 DD |
| 4,173,405 | 11/1979 | Swapceinski et al. | 355/3 DD |
| 4,274,362 | 6/1981 | Beck et al. | 355/3 DD X |

FOREIGN PATENT DOCUMENTS 1285804 8/1972 United Kingdom .

*Primary Examiner*—A. C. Prescott

*Attorney, Agent, or Firm*—H. Fleischer; J. E. Beck; R. Zibelli

[57] ABSTRACT

An apparatus which develops a latent image with marking particles. The marking particles are transported through a path in which the marking particles rotate and translate in the portion of the path remote from the latent image and rotate in the portion of the path adjacent the latent image. In this way, the latent image attracts a portion of the marking particles to form a particle image and the marking particles translate from a receiving region to a discharge region.

22 Claims, 4 Drawing Figures

COMPACT DEVELOPMENT SYSTEM

This invention relates to an electrophotographic printing machine, and more particularly concerns a system for developing a latent image recorded on a photoconductive surface with marking particles.

In a typical electrophotographic printing machine, a photoconductive member is charged to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive surface, the latent image is developed by bringing a developer mixture into contact therewith. This forms a powder image on the photoconductive surface which is subsequently transferred to a copy sheet. Finally, the powder image is heated to permanently affix it to the copy sheet in image configuration.

A common type of developer mixture frequently used in electrophotographic printing machines includes carrier granules having toner particles adhering triboelectrically thereto. This two component mixture is brought into contact with the photoconductive surface. The toner particles are attracted from the carrier granules to the latent image. During usage, toner particles are depleted from the developer mixture and must be periodically replenished therein. As the toner particles are replenished, the newly furnished toner particles must be mixed with the residual carrier granules. Heretofore, mixing of the toner particles with the carrier granules and transportation of the developer mixture to the latent image were all accomplished by separate components disposed within the development system. Furthermore, the transportation of the developer mixture or toner particles to the various portions of the sump was also accomplished by a separate element. In compact development systems, it is highly desirable to combine these various functions so as to reduce the size of the electrophotographic printing machine. Thus, it is advantageous to transport developer material into contact with the latent image while, simultaneously therewith, axially transporting the developer material so that the unused material may be subsequently mixed and returned for reuse with new toner particles. Composite systems which could accomplish all of the foregoing would be extremely compact significantly reducing the size of the development unit. This results in an optimum development system for use in a small desk type copier.

Various techniques have been devised for transporting the developer mixture. The following disclosures appear to be relevant:

U.S. Pat. No. 2,786,439
Patentee: Young
Issued: Mar. 26, 1957

U.S. Pat. No. 2,846,333
Patentee: Wilson
Issued: Aug. 5, 1958

U.S. Pat. No. 3,015,305
Patentee: Hall et al.
Issued: Jan. 2, 1962

U.S. Pat. No. 3,631,838

Patentee: Kushima et al.
Issued: Jan. 4, 1972

U.S. Pat. No. 4,067,296
Patentee: Sessink
Issued: Jan. 10, 1978

U.K. Pat. No. 1,285,804
Published: Aug. 16, 1972

The pertinent portions of the foregoing disclosures may be briefly summarized as follows:

Young describes a brush supporting structure including a lower pole member having portions of greater diameter than the main portion of the rod thereof wrapped helically thereabout. As the pole member rotates, a wavelike agitation of the brush depending from the upper pole member is produced.

Wilson discloses a plurality of spaced disks secured to a shaft at an angle. The disks are closely adjacent to magnets and pass through a trough containing developer material. A high magnetic flux density exists between the magnets and the disk edges. As the disks rotate, they attract developer material and, since they are inclined, thrust the developer material across the plate having a latent image recorded thereon.

Hall et al. describes a plurality of disks secured to a shaft at an angle. The disks are mounted rotatably interiorly of a cylinder and closely proximate to magnets forming a magnetic circuit therewith. As the disks rotate, developer material moves over the cylinder. Since the disks are inclined at an acute angle with respect to the shaft, the lines of magnetic force emanating from the edges of the disks brush the developer material across the plate having the latent image recorded thereon.

Kushima et al. discloses a magnetic roller having a plurality of obliquely sliced magnetic cylinders mounted on a shaft with each of the magnetic cylinders being separated from one another by a spacer ring. The magnetic roller is covered by a non-magnetic cylinder. A series of magnetic brushes are formed obliquely on the cylinder. As the magnetic roller rotates, the magnetic brush ears reciprocate as a whole in the axial direction to cover evenly the entire surface of the photosensitive paper to evenly develop the latent image recorded thereon.

Sessink describes a non-magnetic cylinder rotatably mounted about a magnetic cylinder. A spirally extending groove is formed in the region of each end of the magnetic cylinder. This insures that the developer material moves inwardly away from the ends of the cylinder toward the central region thereof.

The U.K. patent discloses a magnetic cylinder having a plurality of spaced parallel bands or strips which wind helically about the cylinder. The bands form alternating north and south magnetic poles.

In accordance with one aspect of the present invention, there is provided an apparatus for developing a latent image recorded in a surface. Means are provided for transporting marking particles through a path in which the marking particles rotate and translate in the portion of the path remote from the surface and rotate in the portion of the path adjacent the surface so that the latent image attracts at least a portion of the marking particles thereto. This forms a particle image on the surface as the particles translate from a receiving region to a discharge region. Means attract the marking particles to the transporting means.

Pursuant to another aspect of the present invention, there is provided an electrophotographic printing machine of the type in which a development system transports a developer mixture comprising carrier granules having toner particles adhering triboelectrically thereto closely adjacent to an electrostatic latent image recorded on a photoconductive surface. A portion of the toner particles are attracted to the electrostatic latent image forming a toner powder image on the photoconductive surface. Means are provided for transporting the developer material through a path in which the developer material rotates and translates in the portion of the path remote from the photoconductive surface and rotates in the portion of the path adjacent the photoconductive surface so that the latent image attracts at least a portion of the toner particles thereto forming a toner powder image on the photoconductive surface as the developer material translates from a receiving region to a discharging region. Means attract the developer material to the transporting means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
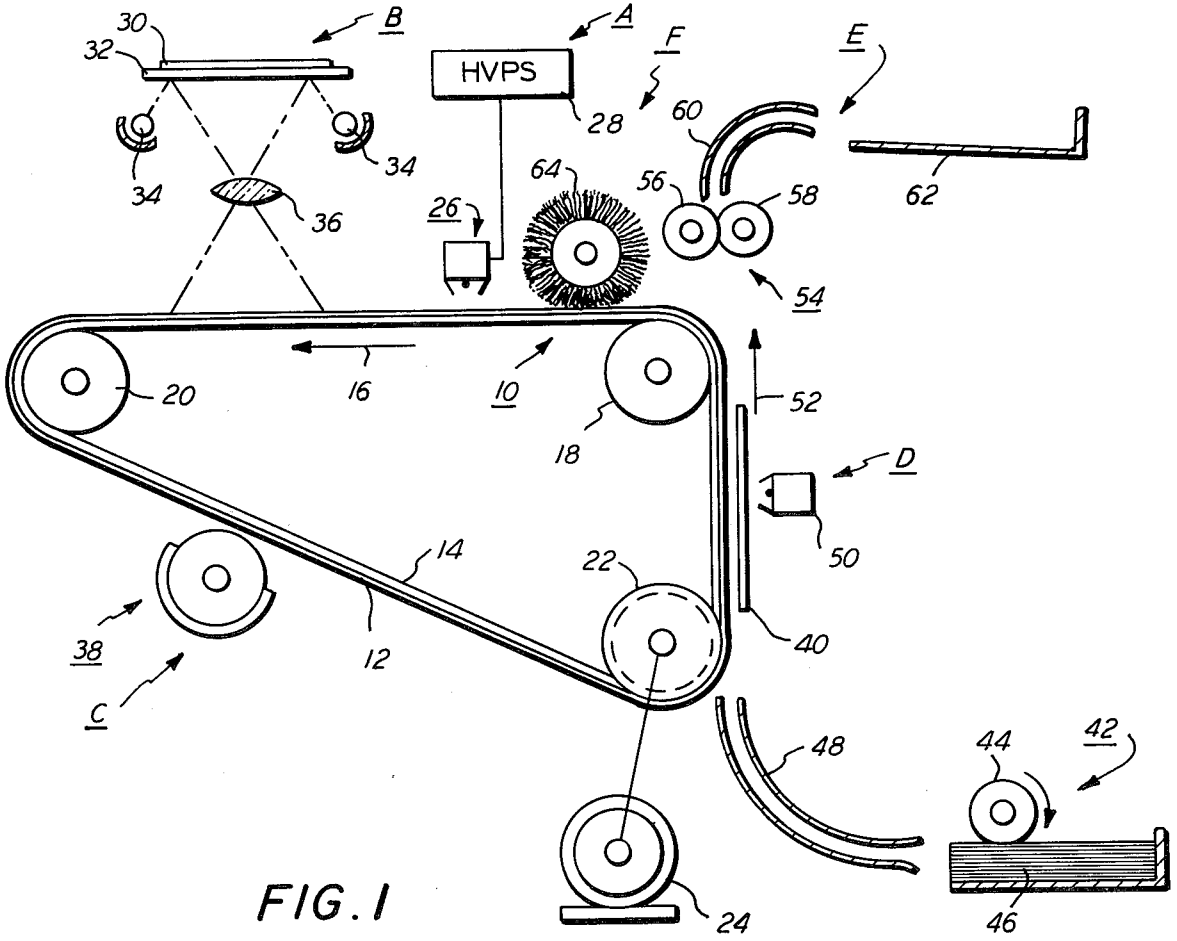
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the features of the present invention therein. It will become apparent from the following discussion that the apparatus of the present invention is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Referring now to FIG. 1, the electrophotographic printing machine employs a belt 10 having a photoconductive surface 12 deposited on a conductive substrate 14. Peferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed along the path of movement thereof. Belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by a suitable means such as a belt drive. Belt 10 is maintained in tension by a pair of springs (not shown) resiliently urging tension roller 20 against belt 10 with the desired spring force. Both stripping roller 18 and tension roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to apply a charge on photoconductive surface 12 of belt 10.

After photoconductive surface of belt 10 is charged, the charged portion thereof is advanced through exposure station B. At exposure station B, an original document 30 is positioned facedown upon a transparent platen 32. Lens 34 flashes light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated generally by the reference numeral 38, advances developer material into contact with the latent image. Development system 38 forms a brush of developer material comprising carrier granules and toner particles which extend outwardly therefrom closely adjacent to and contacting the latent image recorded on photoconductive surface 12 of belt 10. The latent image attracts toner particles from the carrier granules forming a toner powder image. The detailed structure of development system 38 will be described hereinafter with reference to FIGS. 2 through 4, inclusive. After the electrostatic latent image is developed, belt 10 advances the toner powder image to transfer station D.

A sheet of support material 40 is advanced to transfer station D by sheet feeding apparatus 42. Preferably, sheet feeding apparatus 42 includes a feed roll 44 contacting the uppermost sheet of stack 46. Feed roll 44 rotates to advance the uppermost sheet from stack 46 into chute 48. Chute 48 directs the advancing sheet of support material into contact with photoconductive surface 12 of belt 10 in a timed sequence so that the toner powder image developed thereon contacts the advancing sheet of support mateial 40 at transfer staion D.

Transfer station D includes a corona generating device 50 which sprays ions onto the back side of sheet 40. This attracts the toner powder image from photoconductive surface 12 to sheet 40. After transfer, sheet 40 continues to move in the direction of arrow 52 onto a conveyor (not shown) which advances sheet 40 to fusing station E.

Fusing station E includes a fuser assembly, indicated generally by the reference numeral 54, which permanently affixes the transferred powder image to sheet 40. Preferably, fuser assembly 54 comprises a heated fuser roller 56 and a back-up roller 58. Sheet 40 passes between fuser roller 56 and back-up roller 58 with the toner powder image contacting fuser roller 56. In this way, the toner powder image is permanently affixed to sheet 40. After fusing, chute 60 advances sheet 40 to catch tray 62 for subsequent removal from the printing machine by the operator.

After the sheets of support material is separated from photoconductive surface 12 of belt 10, the residual toner particles adhering to photoconductive surface 12 are removed therefrom at cleaning station F. Cleaning station F includes a rotatably mounted fibrous brush 64 in contact with photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
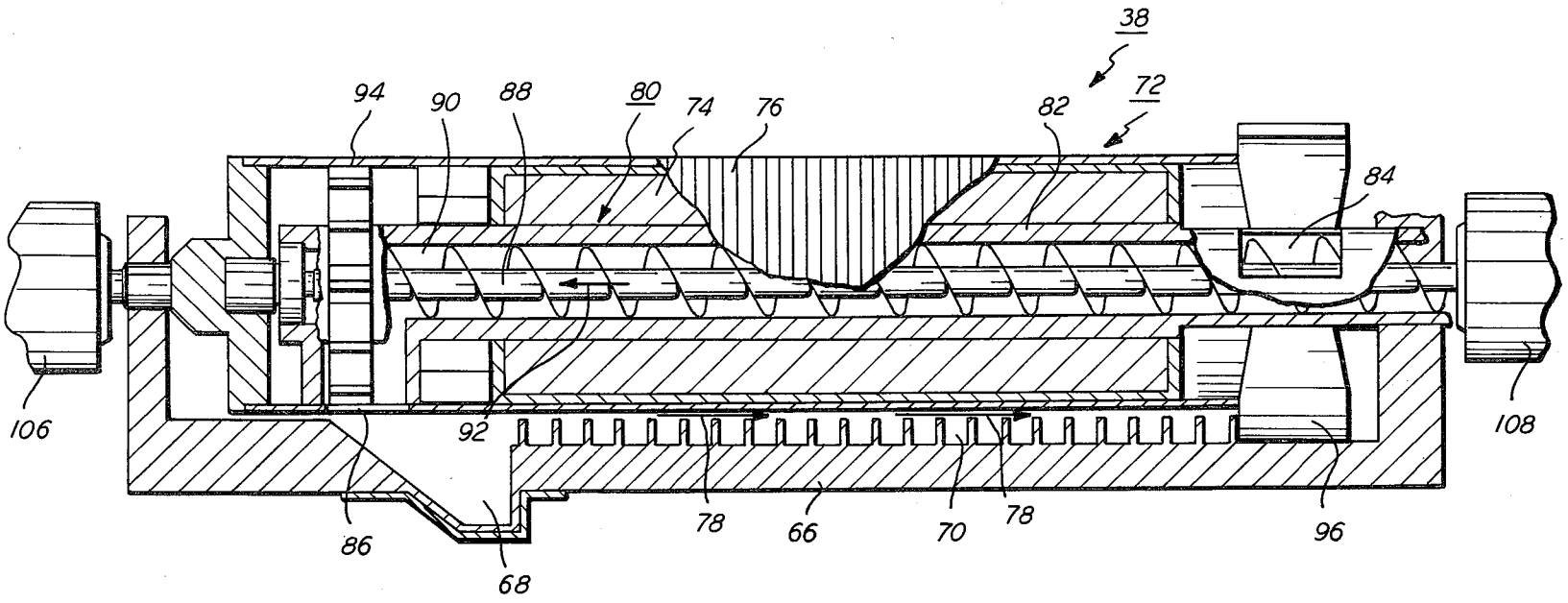
FIG. 2 is a schematic elevational view depicting the development system used in the FIG. 1 printing machine.

Referring now to FIG. 2, development system 38 is depicted thereat in greater detail. As shown, development systsem 38 includes a housing 66 defining a chamber 68 for storing a supply of developer material therein. Chamber 68 is located at one end of housing 66, in the axial direction. Housing 66 has a portion of a spiral groove 70 in the portion thereof positioned closely adjacent to developer roller 72 and located remotely from photoconductive surface 12. Preferably, grooves 70 are helically generated. While grooves 70 have been described as being formed from a portion of a spiral, one skilled in the art will appreciate that grooves 70 may be a plurality of equally spaced grooves positioned transversely to the longitudinal axis of developer roller 72. Preferably, each of the grooves form an acute angle relative to the longitudinal axis of developer roller 72. Developer roller 72 is positioned in housing 66 and arranged to transport developer material into contact with photoconductive surface 12 of belt 10. Developer roller 72 includes an elongated cylindrical magnet 74 mounted interiorly of tubular sleeve 76. Magnet 74 is mounted stationarily with tubular sleeve 76 being mounted rotatably. As tubular sleeve 76 rotates, developer material is advanced into contact with the latent image. Preferably, the exterior circumferential surface of tubular sleeve 76 is roughened in a knurled pattern. In this way, the developer material rotates about the longitudinal axis of sleeve 76 in the region of photoconductive surface 12. As the developer material rotates away from photoconductive surface 12, it enters the influence of grooves 70 in housing 66 which induce the developer material to translate in a direction substantially parallel to the longitudinal axis of sleeve 76 as well as rotating relative thereto. Thus, the developer material moves over a path in which a portion thereof produces rotation of the developer material, i.e. in the region adjacent photoconductive surface 12, and both rotation and translation in the portion of the path remote from photoconductive surface 12. The developer material translates in the direction of arrow 78. Grooves 70 are positioned so to split the flow of developer material between adjacent grooves. This improves mixing of the developer material. By way of example, magnet 74 is made from a barium ferrite material magnetic poles impressed thereon. Tubular sleeve 76 is made preferably from aluminum having the exterior circumferential surface thereof roughened in a knurled pattern.

An auger, indicated generally by the reference numeral 80, is disposed interiorly of magnet 74. Auger 80 includes a tube 82 disposed in a centrally positioned aperture in magnet 74. Tube 82 extends longitudinally from one end of magnet 74 to the other end thereof. Tube 82 includes an aperture or opening 84 disposed in one end region thereof for receiving developer material thereat and another aperture 86, at the opposed end region thereof, for discharging developer material therefrom. Helical member 90 extends in the longitudinal direction about shaft 88. Preferably, helical member 90 is a coiled spring. Motor 108 rotates shaft 88. As shaft 88 rotates, helical member 90 rotates therewith to advance the developer material in the direction of arrow 92. Thus, developer material is received in port 84 and advanced by auger 80 in the direction of arrow 92 to port 86. Developer material is then discharged into chamber 68 and transported by sleeve 76 so as to rotate into contact with the latent image and translate in the direction of arrow 78. In this way, the developer material is continually recirculated about a path parallel to the longitudinal axis of developer roller 38.

Paddle wheel 94 is rotated in unison with sleeve 76 by motor 106. Paddle wheel 94 is positioned to extend into chamber 68 of housing 66 so as to mix the developer material continuously. In this way, the triboelectric characteristics of the toner particles are maintained at the desired level. The detailed structure of paddle wheel 94 will be described hereinafter with reference in FIG. 4.

With continued reference to FIG. 2, a pickup wheel, indicated generally by the reference numeral 96, is disposed at receiving port 84 and is rotated in unison with sleeve 76 by motor 106. Pickup wheel 96 receives the unused developer material which has translated in the direction of arrow 78. The developer material falls, under the influence of gravity, inwardly into auger 80 for subsequent recirculation. The detailed structure of pickup wheel 96 will be described hereinafter with reference to FIG. 3.

Sleeve 76, pickup wheel 96, and paddle wheel 94 are all mounted on a common shaft and rotated by motor 106 in unison with one another. Auger 80 is driven by motor 108. Preferably, Auger 80 rotates at a higher angular velocity than sleeve 76, paddle wheel 94 and pickup wheel 96. One skilled in the art will appreciate that a common motor may be employed in lieu of motors 106 and 108 with the proper drive system therewith. It is evident that a system of this type is extremely compact minimizing the required space for the development system.

Figure 3:
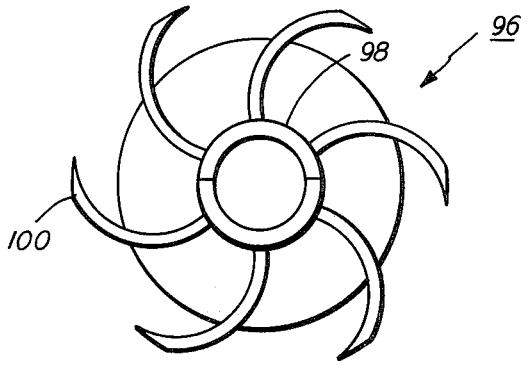
FIG. 3 is an elevational view illustrating the pick-up wheel used in the FIG. 2 development system.

Turning now to FIG. 3, is shown the detailed structure of pickup wheel 96. As illustrated thereat, pickup wheel 96 includes a hub 98 having a plurality of arcuate vanes 100 extending outwardly therefrom. As pickup wheel 96 rotates, the vanes pick up the developer material which falls inwardly, under the influence of gravity, into port 84 for subsequent recirculation by auger 80.

Figure 4:
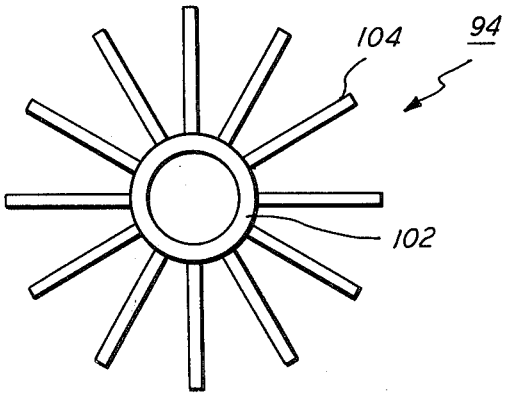
FIG. 4 is an elevational view showing the paddle wheel used in the FIG. 2 development system.

Referring now to FIG. 4, there is shown paddle wheel 94 in greater detail. As depicted thereat, paddle wheel 94 includes a hub 102 having a plurality of substantially equally spaced vanes 104 extending outwardly therefrom. As paddle wheel 94 rotates, vanes 104 agitate and mix the developer material disposed in chamber 68 of housing 66.

In recapitulation, it is clear that the development apparatus of the present invention rotates the developer material into contact with the latent image recorded on the photoconductive surface so as to form a powder image thereon as the developer material translates from a receiving region to a discharge region. The unused developer material is then recirculated in an axial direction so as to be subsequently reused. The paddle wheel arranged to mix the developer material disposed in the chamber of the devloper housing and the sleeve adapted to transport the developer material into contact with the latent image are mounted on a common shaft for rotation in unison therewith. Furthermore, a pickup wheel, arranged to move the unused developer material into the auger for subsequent recirculation, is also mounted on this shaft. In this way, a compact development system minimizing space requirements is achieved.

It is, therefore, evident that there has been provided in accordance with the present invention, a development system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image recorded on a surface, including:

means for transporting marking particles through a path in which the marking particles rotate and translate in the portion of the path remote from the surface and rotate in the portion of the path adjacent the surface so that the latent image attracts at least a portion of the marking particles thereto forming a particle image on the surface as marking particles translate from a receiving region to a discharge region said transporting means includes a rotatably mounted elongated sleeve and a housing having a portion of the interior surface thereof adjacent to a portion of said sleeve with said housing having a plurality of grooves in the portion of the interior surface thereof adjacent said sleve with each groove being transverse to the longitudinal axis of said sleeve; and means for attracting the marking particles to said sleeve.

2. An apparatus according to claim 1, further including means for returning the marking particles from the discharge region to the receiving region.

3. An apparatus according to claim 2, further including means, positioned at the receiving region, for storing a supply of marking particles.

4. An apparatus according to claim 3, further including means, positioned at the receiving region, for mixing the marking particles being discharged from said returning means with the marking particles in said storing means.

5. An apparatus according to claim 4, further including means, positioned at the discharge region, for moving the marking particles from said transporting means to said returning means for subsequent recirculation by returning means.

6. An apparatus according to claim 5, wherein said returning means includes:

a stationary elongated tube disposed interiorly of said sleeve, said tube having an aperture at the receiving region to discharge marking particles thereat and an aperture at the discharge region to receive marking particles therein; and an elongated helical member mounted rotatably in said tube for moving the marking particles from the discharging region to the receiving region.

7. An apparatus according to claim 6, wherein said mixing means includes a rotatably mounted paddle wheel.

8. An apparatus according to claim 7, wherein said moving means includes a rotatably mounted hub having a plurality of spaced, arcuate vanes extending outwardly therefrom.

9. An apparatus according to claim 8, wherein said attracting means includes a substantially stationarily mounted elongated magnetic cylinder disposed interiorly of said sleeve with the exterior circumferential surface of said cylinder being spaced from the interior surface of said sleeve, said magnetic cylinder having an interior aperture extending in a direction substantially parallel to the longitudinal axis thereof in which said tube is mounted.

10. An apparatus according to claim 1, wherein the grooves in said housing generate a portion of a spiral path.

11. An apparatus according to claim 1, wherein the grooves in said housing split the flow of developer material between adjacent grooves to improve mixing thereof.

12. An electrophotographic printing machine of the type in which a development system transports a developer mixture comprising carrier granules having toner particles adhering triboelectrically thereto closely adjacent to an electrostatic latent image recorded on a photoconductive surface so that a portion of the toner particles are attracted to the electrostatic latent image forming a toner powder image on the photoconductive surface, wherein the improvement includes:

means for transporting the developer material through a path in which the developer material rotates and translates in the portion of the path remote from the photoconductive surface and rotates in the portion of the path adjacent the photoconductive surface so that the latent image attracts at least a portion of the toner particles thereto forming a toner powder image on the photoconductive surface as the developer material translates from a receiving region to a discharge region said transporting means includes a rotatably mounted elongated sleeve, and a housing having a portion of the interior surface thereof adjacent to a portion of said sleeve with said housing having a plurality of grooves in the portion of the interior surface thereof adjacent said sleeve with each groove being transverse to the longitudinal axis of said sleeve; and means for attracting the developer material to said sleeve.

13. A printing machine according to claim 12, further including means for returning the developer material from the discharge region to the receiving region.

14. A printing machine according to claim 13, further including means, positioned at the receiving region, for storing a supply of developer material.

15. A printing machine according to claim 14, further including means positioned at the receiving region, for mixing the developer material being discharged from said returning means with the developer material in said storing means.

16. A printing machine according to claim 15, further including means positioned at the discharge region, for moving the developer material from said transporting means to said returning means for subsequent recirculation by said returning means.

17. A printing machine according to claim 16, wherein said returning means includes:

a stationary elongated tube disposed interiorly of said sleeve, said tube having an aperture at the receiving region to discharge developer material thereat and an aperture at the discharge region to receive developer material therein; and an elongated helical member mounted rotatably in said tube for moving the developer material from the discharge region to the receiving region.

18. A printing machine according to claim 17, wherein said mixing means includes a rotatably mounted paddle wheel.

19. A printing machine according to claim 18, wherein said moving means includes a rotatably mounted hub having a plurality of spaced, arcuate vanes extending outwardly therefrom.

20. A printing machine according to claim 19, wherein said attracting means includes an elongated magnetic cylinder disposed interiorly of said sleeve with the exterior circumferential surface thereof being spaced from said sleeve, said magnetic cylinder having an aperture extending in the longitudinal direction in which said tube is mounted, said magnetic cylinder being substantially stationary.

21. A printing machine according to claim 12, wherein the grooves in said housing generate a portion of a spiral path.

22. A printing machine according to claim 12, wherein the grooves in said housing split the flow of developer material between adjacent grooves to improve mixing thereof.

* * * * *